US006199329B1

(12) United States Patent
Witter

(10) Patent No.: US 6,199,329 B1
(45) Date of Patent: Mar. 13, 2001

(54) LIQUID STORAGE SYSTEM

(75) Inventor: Aldyr Witter, deceased, late of Sao Leopoldo (BR), by Roger V. Witter, legal representative

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

(21) Appl. No.: 09/228,422

(22) Filed: Jan. 12, 1999

(30) Foreign Application Priority Data

Jan. 13, 1998 (BR) ..... 9800288

(51) Int. Cl.[7] ..... B65D 25/24

(52) U.S. Cl. ..... 52/167.7; 52/192; 52/245; 220/506.03; 220/565; 405/53

(58) Field of Search ..... 52/169.1, 169.7, 52/245, 247, 259, 192–196; 405/53, 62, 264; 220/506.05, 506.04, 565

(56) References Cited

U.S. PATENT DOCUMENTS

| | | | | |
|---|---|---|---|---|
| 214,343 | * | 4/1879 | Ames | 52/169.7 |
| 254,112 | * | 2/1882 | Chesebrough | 405/62 |
| 734,045 | * | 7/1903 | Castleman | 52/169.7 X |
| 3,504,496 | * | 4/1970 | Hnot | 403/53 |
| 3,791,164 | * | 2/1974 | Laverman | 220/506.03 |
| 3,930,590 | * | 1/1976 | Ebbrell | 220/506.03 |
| 3,940,940 | * | 3/1976 | Barrett | 405/264 X |
| 4,209,267 | * | 6/1980 | Gnaedinger | 405/53 |
| 4,451,173 | * | 5/1984 | Watson et al. | 405/53 |

FOREIGN PATENT DOCUMENTS

| | | |
|---|---|---|
| 2 553 457 | 4/1985 | (FR) . |
| 826742 | 1/1960 | (GB) . |

* cited by examiner

*Primary Examiner*—Richard Chilcot
(74) *Attorney, Agent, or Firm*—Nixon & Vanderhye PC

(57) ABSTRACT

This invention relates to a liquid storage system for storing liquid products, particularly petroleum and its derivatives. An auxiliary dam (1) within a bund defined by a main dam (3) bounds an area (5) around a tank (2) in such a way that the contaminating wastes from the fluids stored in the tank are contained within that area (5). This arrangement reduces the volume of contaminated rainwater within the bund, consequently reducing the costs of water treatment for subsequent discharge to the stormwater drain system

5 Claims, 2 Drawing Sheets

LIQUID STORAGE SYSTEM

FIELD OF THE INVENTION

This invention relates to a liquid storage system, comprising a storage tank and a surrounding bund, for the storage of liquid products, particularly petroleum and its derivatives, and is designed to reduce the contaminated area around the tank with a view to reducing the cost of treating wastes and rainwater.

PRIOR ART

Storage tanks are widely used in the oil industry and are essential to the functioning of an operational unit. They may be used for example for the storage of crude oil, intermediate products and final products.

The surrounding area around a tank is protected by a dam built around the immediate surroundings to the tank in order to contain the total volume of fluid stored in the tank in the event of an accident. Together with the outside wall of the tank, this dam bounds a region known as a bund. For the drainage of the wastes produced when it is cleaned, such a tank will also have a system consisting of gutters which drain the wastes to a drainage system which carries the fluid to a water separation system. When rainwater collects in the bund, this water will come into contact with any stored such wastes which may already be deposited in the bund.

Thus all such collected contaminated water has to be treated in order to separate it from any contaminating waste, before it can be subsequently discharged into the stormwater drain system. Normally a very large volume of water has to be treated because the bund is of large area. This treatment is quite expensive and represents a considerable portion of the operating and maintenance costs for an operating unit.

The present invention aims to make it possible to reduce the area of the bund which is likely to become contaminated, bringing about a substantial reduction in the volume of water which has to be treated, which appreciably reduces the costs of operating and maintaining operating units.

SUMMARY OF THE INVENTION

This invention is characterised by the features of claim 1. Such a system makes it possible to reduce the volume of contaminated water needing treatment by units for the production and storage of contaminating fluids. This reduction is preferably enhanced by ensuring that the area bounded by the auxiliary dam is very much smaller than the total area bounded by the main dam. This limited area is then used as a service area which collects all the water which contains contaminants from the tank, and only this smaller volume of water has to be treated in order to be dischargable to the stormwater drain system.

BRIEF DESCRIPTION OF THE DRAWINGS

The invention will now be described in greater detail, merely by way of examples, by reference to the accompanying drawings listed below which supplement this description of which they are an integral part. In the drawings.

DETAILED DESCRIPTION OF THE INVENTION

Figure 1:
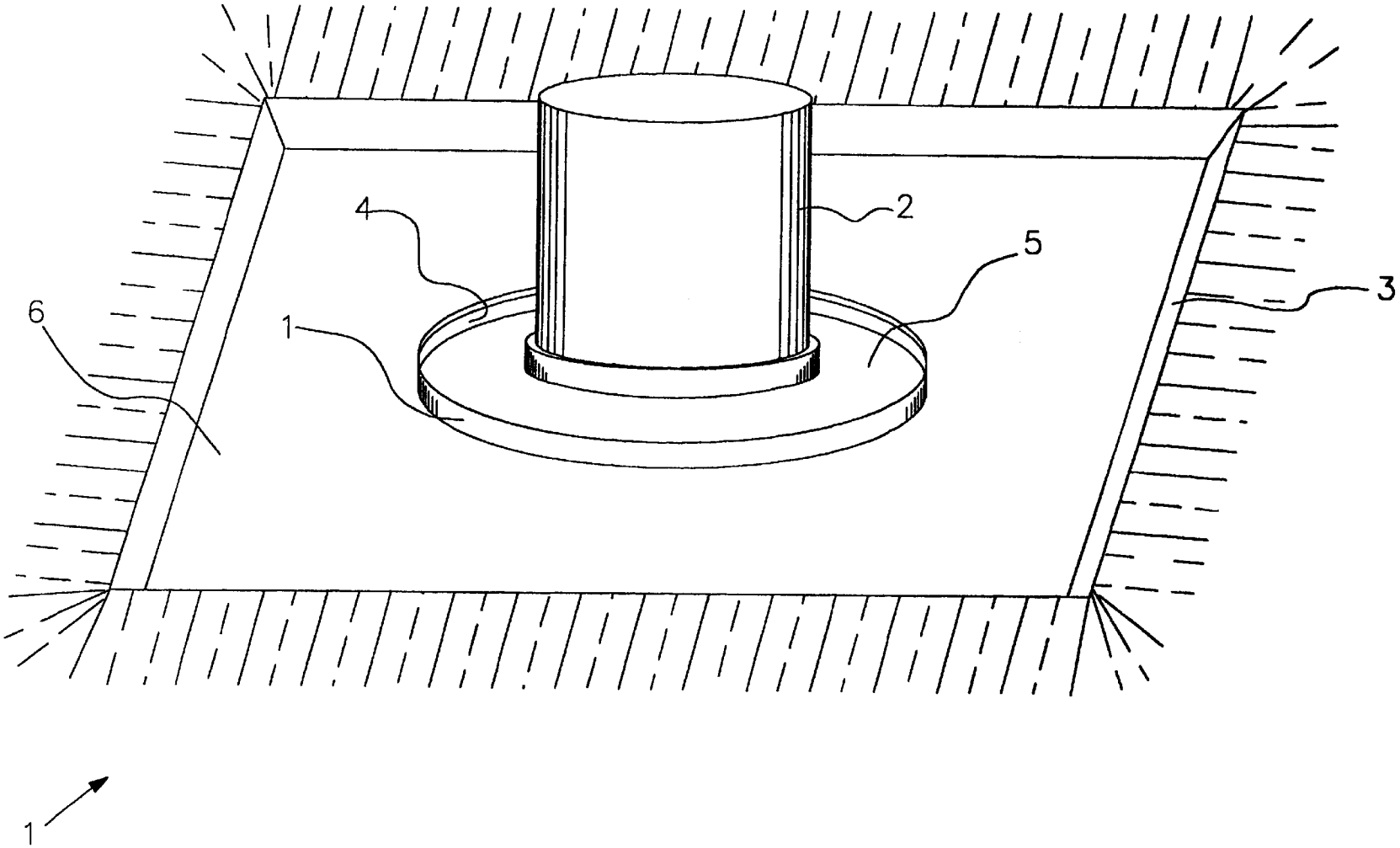
FIG. 1 is a perspective view showing the auxiliary dam system according to this invention applied to a tank intended for the storage of liquid products.

FIG. 1 shows a perspective view of a storage tank 2, with its corresponding dam 3, which bounds a bund. It should be pointed out that tank 2 and dam 3 are only shown in order to enable the function of the subject-matter of this invention, that is the auxiliary dam system, to be understood.

An auxiliary dam 1 totally surrounds storage tank 2 and is located between dam 3 and storage tank 2 to isolate an inner area 5, which should be as small as possible, between the storage tank 2 and the inner wall 4 of auxiliary dam 1. This is necessary in order to reduce the volume which has to be drained from inner area 5, because this is very much smaller than the main, outer area 6.

Figure 2:
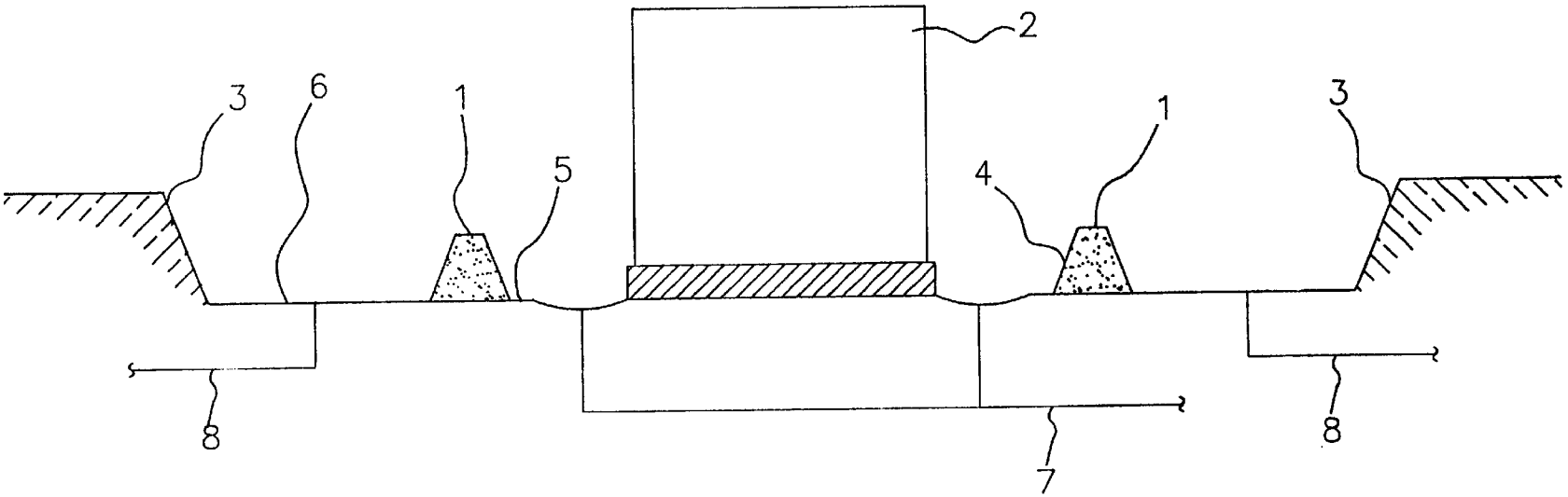
FIG. 2 is a cross-sectional view of the auxiliary dam system used with a tank intended for the storage of liquid products.

FIG. 2 shows an internal drainage system 7 through which contaminated water is drained off to a treatment system. An external drainage system 8, used for draining off water which falls into the outer area 6 of the bund, can also be seen.

In this way by isolating an inner area 5, bounded by auxiliary dam 1, within the total area of the bund it is possible under normal operating conditions to drain off all the water captured in outer area 6 of the bund using the outer drainage system 8. In this way water is drained off directly to the stormwater drain system without the need for treatment to separate out contaminating wastes.

Inner area 5 then serves as a service area in which all the wastes (oil, sludge, etc.) which contaminate water in normal operation are concentrated. These wastes have to be separated from the water (originating from tank washes or rainfall) so that this can be delivered to the stormwater drain system.

An additional advantage of separating the bund into two areas is that outer area xi can be kept permanently filled with a small volume of hopefully uncontaminated water, which can for example have a depth equivalent to approximately 20% of the total height of a dam 3 used to define a normal bund. This avoids the growth of ground-hugging vegetation in the outer area 6, which makes it virtually unnecessary to perform the work of removing ground hugging vegetation in this outer area 6, further reducing maintenance costs.

In this case the height of the main dam 3 of the bund is increased by an amount equivalent to the depth of the volume of liquid maintained in outer area 6. It should be mentioned that the value of 20% additional height mentioned is only a suggestion, and should not in any way be regarded as limiting the invention.

In conclusion, the present invention results in a substantial reduction in operating and maintenance costs in units for the production and storage of fluids, in particular petroleum derivatives, as it drastically reduces the volume of water treated in these production units.

It should be pointed out that the choice of the correct cross-section of the auxiliary dam 1, the material of which it is made, its position, and its dimensions will be defined in accordance with the characteristics of the locality in which it is built, such as e.g. the rainfall, which will determine the ideal height of the auxiliary dam so that the volume of water which accumulates in a specific period of rainfall does not exceed the height of auxiliary dam 1 and contaminate the entire bund.

It should also be noted that the volume occupied by auxiliary dam 1 itself should be taken into consideration when calculating the total volume which has to be confined within dam 3, so that the requirements specified in current regulations are met.

What is claimed is:

1. A liquid storage system comprising:

a liquid product storage tank;

a main dam surrounding said liquid product storage tank and bounding a bund;

an auxiliary dam which wholly surrounds said liquid product storage tank and is positioned between said main dam bounding said bund and an outer wall of said liquid product storage tank so as to define, within the said bund, an inner area and an outer area, said inner area surrounding said liquid storage tank for receiving contaminating wastes from said liquid storage tank, said outer area being bounded by the auxiliary dam at an inner periphery thereof and by said main dam bounding said bund at an outer periphery thereof, said outer area being substantially free of said contaminating wastes, said auxiliary dam being positioned adjacent an outer wall of said liquid product storage tank whereby said inner area is substantially smaller than said outer area; and a volume of substantially uncontaminated water maintained in said outer area between said auxiliary dam and said main dam, said volume of water having a depth sufficient to substantially inhibit growth of vegetation in said outer area.

2. A liquid storage system according to claim 1, wherein said inner area, said outer area and a height of said main dam together define a volume at least as great as a total of a storage volume of said liquid product storage tank, a volume of contaminating wastes in said inner area, and said uncontaminated volume of water in said outer area.

3. A liquid storage system according to claim 1, wherein the height of the main dam exceeds by 20% a minimum height for containing said storage volume of said liquid product storage tank and said contaminating wastes.

4. A liquid storage system according to claim 1, wherein a height of said main dam bounding said bund exceeds a minimum height for containing a storage volume of said liquid product storage tank and said contaminating wastes by an amount corresponding to a depth of said volume of substantially uncontaminated water maintained in said outer area.

5. A liquid storage system according to claim 4, wherein the height of the main dam exceeds said minimum height by at least about 20%.

* * * * *